US012279690B1

(12) United States Patent
Cao

(10) Patent No.: US 12,279,690 B1
(45) Date of Patent: Apr. 22, 2025

(54) INTEGRALLY ELECTRIC AND MANUAL CLEANING APPARATUS AND STORAGE BOX

(71) Applicant: Shenzhen Hongkai Industrial Co., Ltd., Shenzhen (CN)

(72) Inventor: Chuanqing Cao, Shenzhen (CN)

(73) Assignee: Shenzhen Hongkai Industrial Co., Ltd., Shenzhen (CN)

( * ) Notice: Subject to any disclaimer, the term of this patent is extended or adjusted under 35 U.S.C. 154(b) by 0 days.

(21) Appl. No.: 18/900,900

(22) Filed: Sep. 30, 2024

(30) Foreign Application Priority Data

Mar. 8, 2024 (CN) ..... 202410265755.8
Mar. 8, 2024 (CN) ..... 202420448853.0

(51) Int. Cl.

| | |
|---|---|
| ***A46B 13/02*** | (2006.01) |
| ***A46B 7/04*** | (2006.01) |
| ***A46B 13/00*** | (2006.01) |
| ***A46B 17/08*** | (2006.01) |

(52) U.S. Cl.
CPC ..... *A46B 13/02* (2013.01); *A46B 7/042* (2013.01); *A46B 13/001* (2013.01); *A46B 17/08* (2013.01); *A46B 2200/30* (2013.01)

(58) Field of Classification Search
CPC ..... A46B 13/02; A46B 7/042; A46B 17/08; A46B 13/001
See application file for complete search history.

(56) References Cited

U.S. PATENT DOCUMENTS

2014/0157535 A1 6/2014 Minkler et al.

FOREIGN PATENT DOCUMENTS

CN 218355981 U * 1/2023
JP 3227123 U * 8/2020 ..... A46B 13/001

* cited by examiner

*Primary Examiner* — Shay Karls

(57) ABSTRACT

The present invention discloses an integrally electric and manual cleaning apparatus and a storage box. The cleaning apparatus includes a cleaning portion and a drive portion. The cleaning portion is mounted on the drive portion, and includes a sleeve tube, a connecting seat, an electric brush head, and a clamping mechanism. The clamping mechanism includes a trigger, a clamping assembly, and a linkage assembly. The trigger is mounted on the sleeve tube, the clamping assembly extends out of the connecting seat, and the linkage assembly is located between the trigger and the clamping assembly; and the brush head is mounted on the clamping assembly. The storage box includes a storage body and placement brackets.

9 Claims, 12 Drawing Sheets

INTEGRALLY ELECTRIC AND MANUAL CLEANING APPARATUS AND STORAGE BOX

BACKGROUND

1. Technical Field

The present invention relates to the technical field of cleaning devices, particularly to an integrally electric and manual cleaning apparatus and a storage box.

2. Background Information

The cleaning brushes are divided into electric and manual types. Currently, similar products on the market are either purely manual, where the electric brush head cannot be used and replacing the brush head requires handling the dirty brush head manually, or purely electric, where the manual brush head cannot be used. The electric cleaning brush typically includes a cleaning brush body and a brush head. The cleaning brush body is provided with a motor and a reducer, with the brush head connected to the reducer. The motor reducer controls and drives the brush head to rotate via a circuit board, thereby using the brush head for a cleaning operation. However, the existing electric cleaning brush is typically mounted with only an electric brush head and cannot accommodate a manual brush head. As a result, when a manual cleaning operation is required, the electric cleaning brush cannot be used, with a single function, making it difficult to meet various cleaning needs in daily life. Therefore, it is necessary to design an integrally electric and manual cleaning apparatus to address the above problem.

BRIEF SUMMARY

Given the technical defects in the prior art, the main objective of the present invention is to provide an integrally electric and manual cleaning apparatus and a storage box. A clamping mechanism is disposed in the electric cleaning apparatus, such that the electric cleaning apparatus can also be used for manual operation, allowing the user to freely choose between electric and manual cleaning modes based on specific cleaning needs. Additionally, the cleaning apparatus does not require manual contact with a disposable brush head during disassembly and assembly of the disposable brush head, making the operation more hygienic, quick and convenient.

To achieve the foregoing objective, the present invention is implemented using the following technical solution.

An integrally electric and manual cleaning apparatus is provided, including a cleaning portion and a drive portion configured to drive the cleaning portion to rotate. The cleaning portion is mounted at an output end of the drive portion, and the cleaning portion includes a sleeve tube, a connecting seat mounted at a lower end of the sleeve tube, an electric brush head detachably mounted on the connecting seat, and a clamping mechanism configured to mount a disposable brush head. The clamping mechanism includes a trigger, a clamping assembly, and a linkage assembly. The trigger is mounted on the sleeve tube in a pressable manner, the clamping assembly extends out of the connecting seat, and the linkage assembly is located on an inner side of the sleeve tube and connected between the trigger and the clamping assembly. The disposable brush head is detachably mounted on the clamping assembly.

In a preferred solution, the linkage assembly includes a drive rod, a first resetting member, and a second resetting member. The drive rod is vertically slidably mounted in the sleeve tube. A fitting slope is disposed at an upper end of the drive rod, the trigger serves as a button, a drive slope in correspondence to the fitting slope is disposed at a lower end of the button, and the drive slope is in slidable contact with the fitting slope. The first resetting member abuts between the button and an inner wall of the sleeve tube. The second resetting member abuts between a lower end of the drive rod and the connecting seat. The clamping assembly includes two clamping blocks and an elastic member abutting between the two clamping blocks, and two upper ends of the two clamping blocks are both hinged with the lower end of the drive rod. A middle portion of the connecting seat is provided with an extension hole for the two clamping blocks to extend out, so as to limit the two clamping blocks, thus keeping the two clamping blocks in a closed state.

In a preferred solution, the extension hole is square-shaped, an inner side wall of the extension hole is slope-shaped, and the overall extension hole gradually widens from top to bottom.

In a preferred solution, a lower surface of the connecting seat is provided with a retaining block, an upper end of the electric brush head is provided with a fitting groove, a wall surface of the fitting groove is provided with a retaining hole in correspondence with the retaining block, and the retaining block is detachably mounted in the retaining hole.

In a preferred solution, an outer wall of the sleeve tube is provided with an accommodation hole for accommodating the trigger, a side wall of the trigger is provided with a limiting step for preventing the trigger from detaching from the accommodation hole, and the limiting step blocks an edge on an inner side of the accommodation hole. The fitting slope of the drive rod is provided with a limit sliding groove in correspondence with the trigger, and the drive slope of the trigger is located in the limit sliding groove.

In a preferred solution, lower ends of the two clamping blocks are both provided with an arc-shaped groove, the disposable brush head includes a brush head body and a connector connected to a middle portion of the brush head body, and the connector is sphere-shaped and detachably retained in the arc-shaped groove.

In a preferred solution, the drive portion includes a handle housing, a battery mounted in the handle housing, a motor, and a coupling. The battery is mounted at an upper end of an inner side of the handle housing, the motor is mounted at a lower end of the inner side of the handle housing and electrically connected to the battery, and the coupling is mounted at a shaft end of the motor and connected to the cleaning portion.

In a preferred solution, a lower end of the sleeve tube is provided with an accommodation recess, the accommodation recess is polygonal, and a support step is disposed in the accommodation recess. The connecting seat in correspondence with the accommodation recess is also polygonal and detachably mounted on the support step.

A storage box for storing the above integrally electric and manual cleaning apparatus includes a storage body and placement brackets that are foldable to be mounted on two sides of the storage body for placement of the electric brush head. The storage body is provided with a first storage cavity for placing the cleaning apparatus and a second storage cavity for placing multiple such disposable brush heads.

In a preferred solution, the storage body is provided with an observation window, in correspondence with the second storage cavity, for observing the number of the disposable brush heads in the second storage cavity; and a button-type cover plate is mounted at an entrance of the second storage cavity.

Compared with the prior art, the present invention has significant advantages and beneficial effects. Specifically, as can be seen from the above technical solution, as a clamping mechanism that can clamp a disposable brush head is disposed in the electric cleaning apparatus, the electric cleaning apparatus can also be used for a manual cleaning operation. This allows the user to freely choose between electric and manual cleaning modes based on specific cleaning needs, resulting in convenient use. The clamping mechanism does not require manual contact with the disposable brush head during the operations of clamping and releasing the disposable brush head, which avoids direct manual contact with the dirty disposable brush head when the disposable brush head is replaced, making the operation process more hygienic. Additionally, the pressable linkage clamping and releasing operations make the disassembly and assembly of the disposable brush head quicker and more convenient. Additionally, a storage box is designed for the cleaning apparatus. This storage box stores not only the cleaning apparatus but also the electric brush head and the disposable brush head, bringing numerous conveniences to the user.

To more clearly explain the structural features and effects of the present invention, the following detailed description is provided with reference to the accompanying drawings and specific embodiments.

Figure 1:
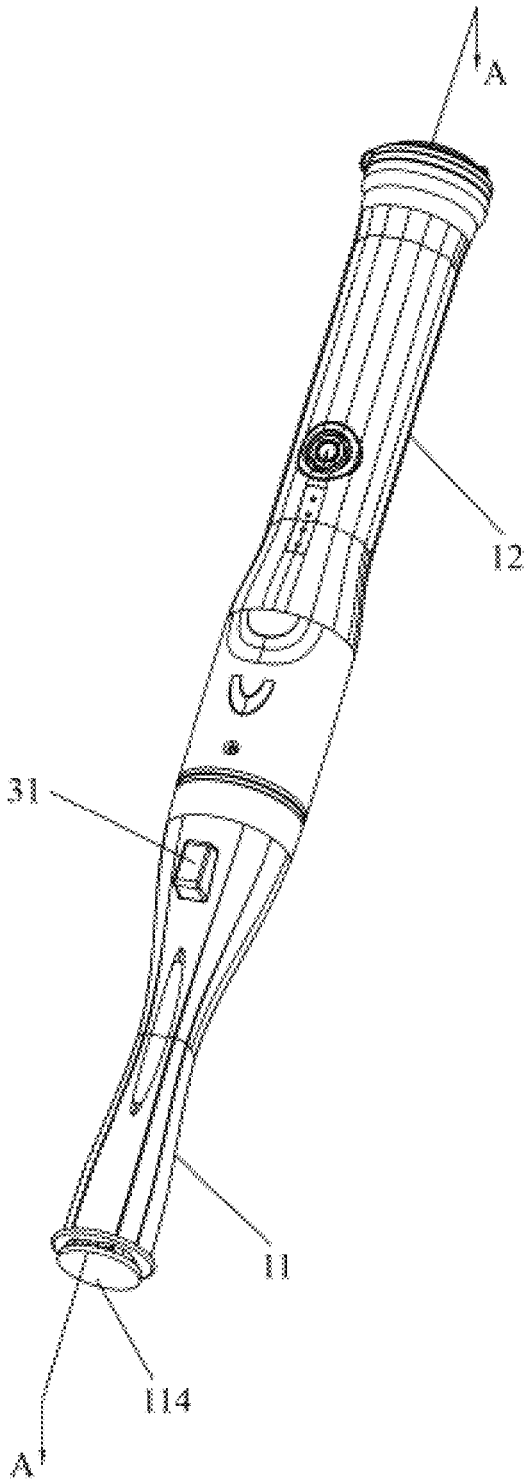
FIG. 1 is a schematic three-dimensional diagram of a cleaning apparatus mounted with a disposable brush head according to the present invention.

Description of numeral references in the drawings:

10. cleaning apparatus; 11. cleaning portion; 111. sleeve tube; 1111. accommodation hole; 1112. accommodation recess; 1113. support step; 112. connecting seat; 1121. retaining block; 1122. extension hole; 113. electric brush head; 1131. fitting groove; 1132. retaining hole; 114. disposable brush head; 1141. brush head body; 1142. connector; 12. drive portion; 121. handle housing; 122. battery; 123. motor; 124. coupling; 20. storage box; 21. storage body; 211. first storage cavity; 212. second storage cavity; 213. observation window; 214. cover plate; 215. storage slot; 216. retaining protrusion; 22. placement bracket; 221. horizontal support member; 2211. sliding groove; 222. inclined support member; 30. clamping mechanism; 31. trigger; 311. drive slope; 312. limiting step; 32. clamping assembly; 321. clamping block; 322. elastic member; 323. arc-shaped groove; 33. linkage assembly; 331. drive rod; 3311. fitting slope; 3312. limit sliding groove; 332. first resetting member; and 333. second resetting member.

DETAILED DESCRIPTION OF THE DRAWINGS AND THE PRESENTLY PREFERRED EMBODIMENTS

Figure 2:
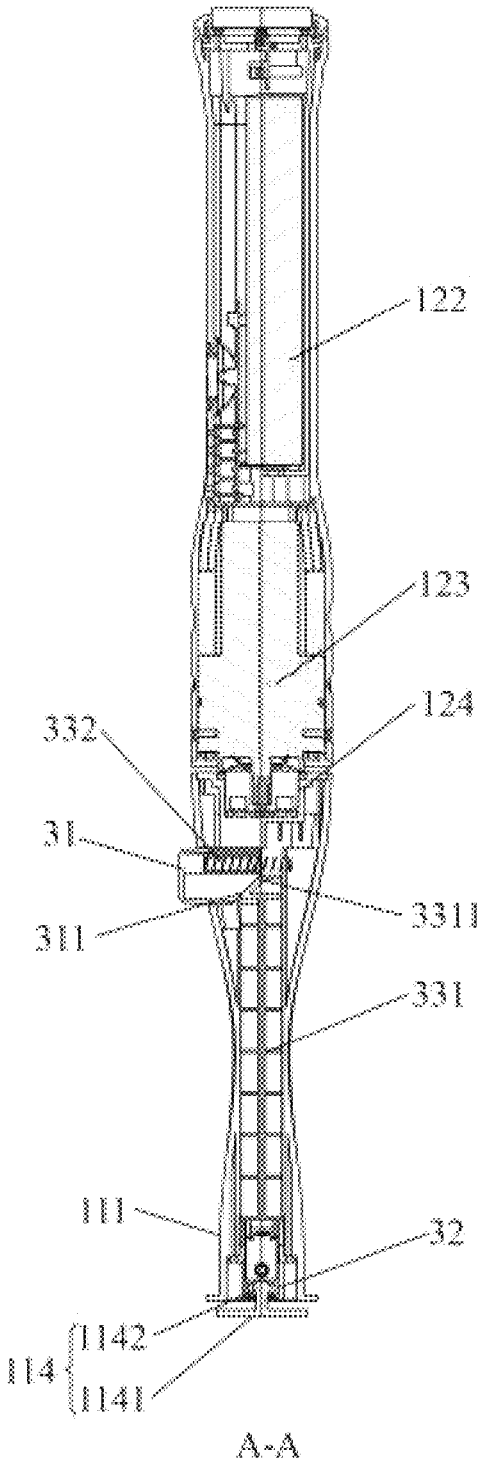
FIG. 2 is a schematic cross-sectional view along A-A of FIG. 1.
Figure 3:
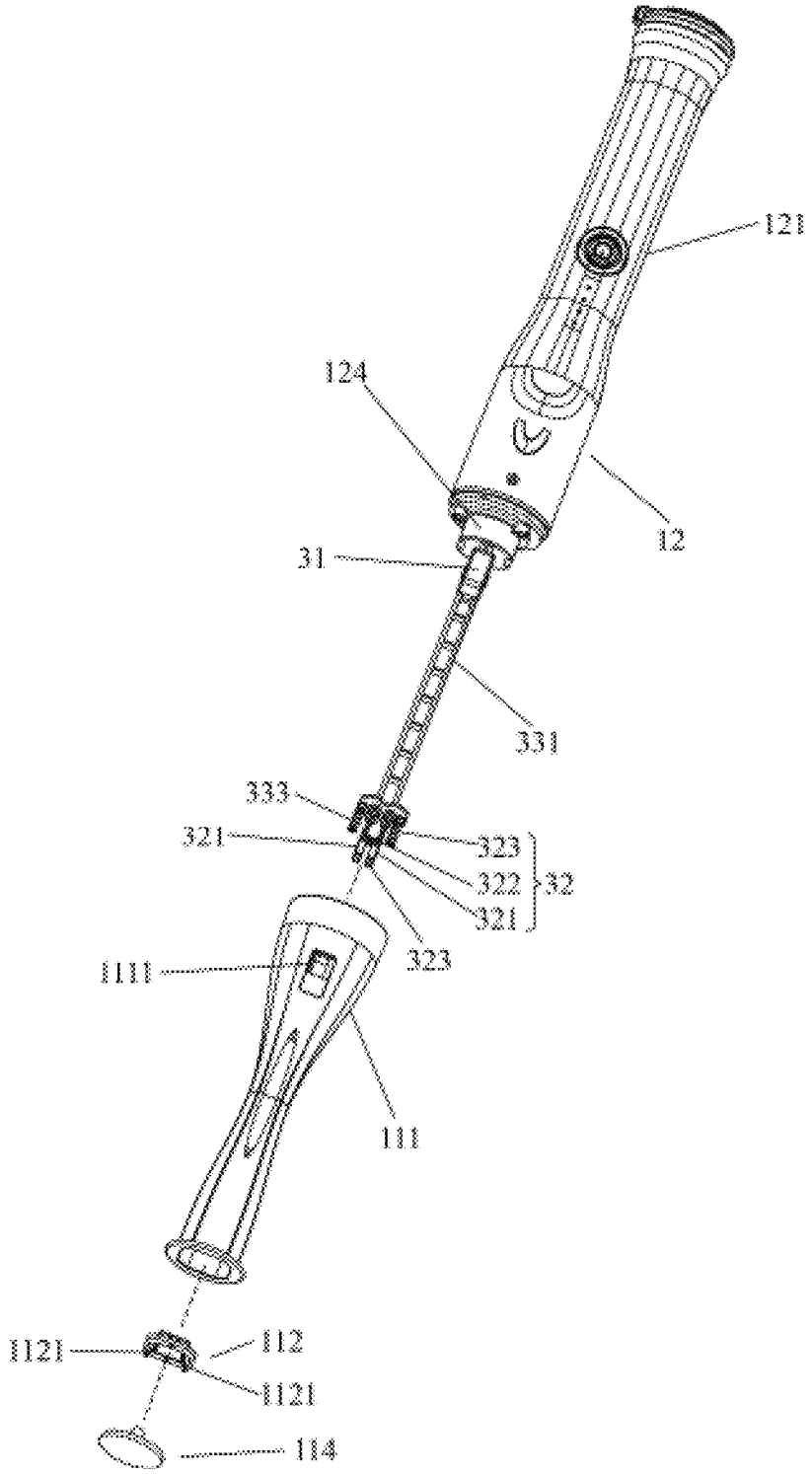
FIG. 3 is a schematic exploded three-dimensional diagram of the cleaning apparatus according to the present invention.
Figure 4:
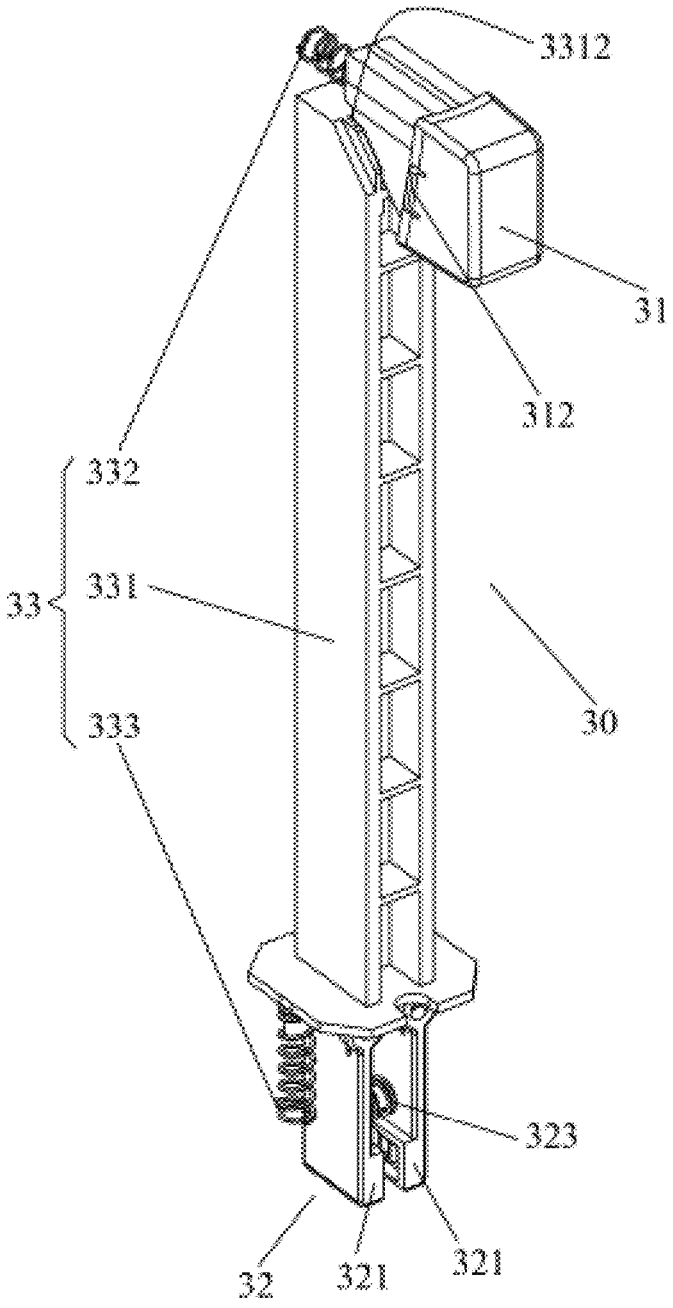
FIG. 4 is a schematic three-dimensional diagram of a clamping mechanism according to the present invention.
Figure 5:
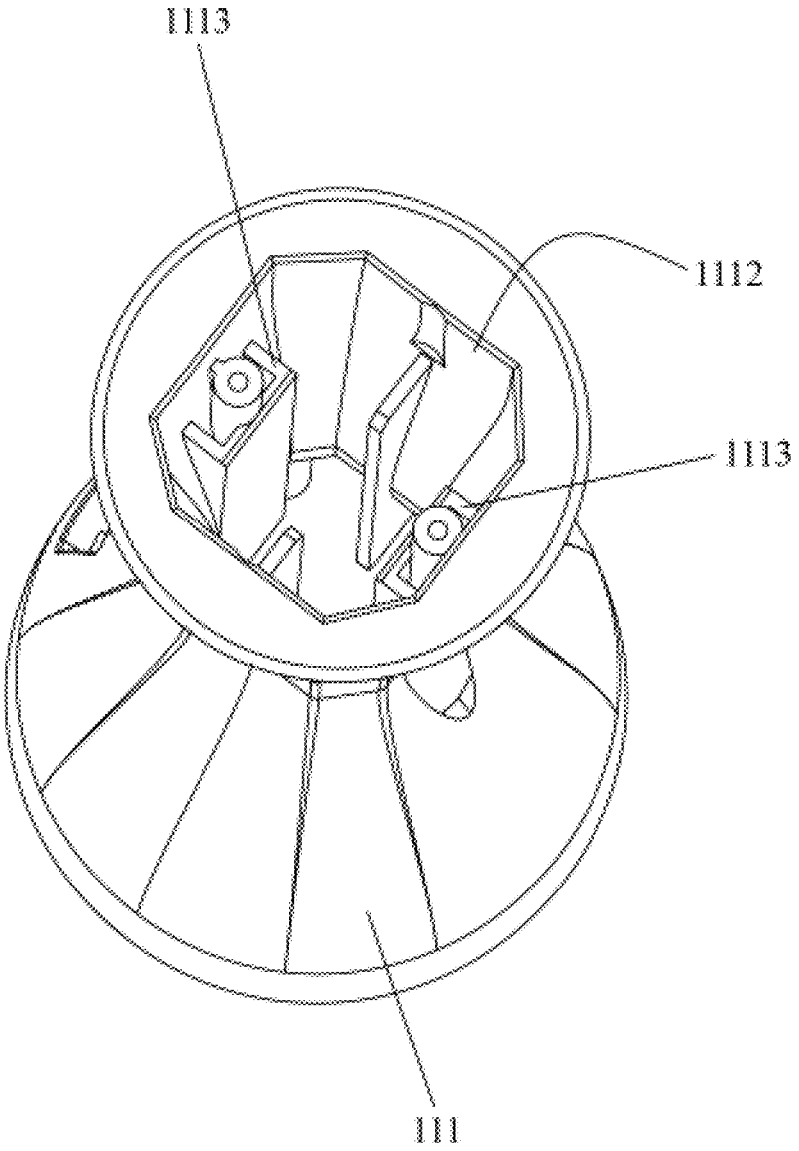
FIG. 5 is a schematic three-dimensional diagram of an internal structure of a lower end of a sleeve tube according to the present invention.
Figure 6:
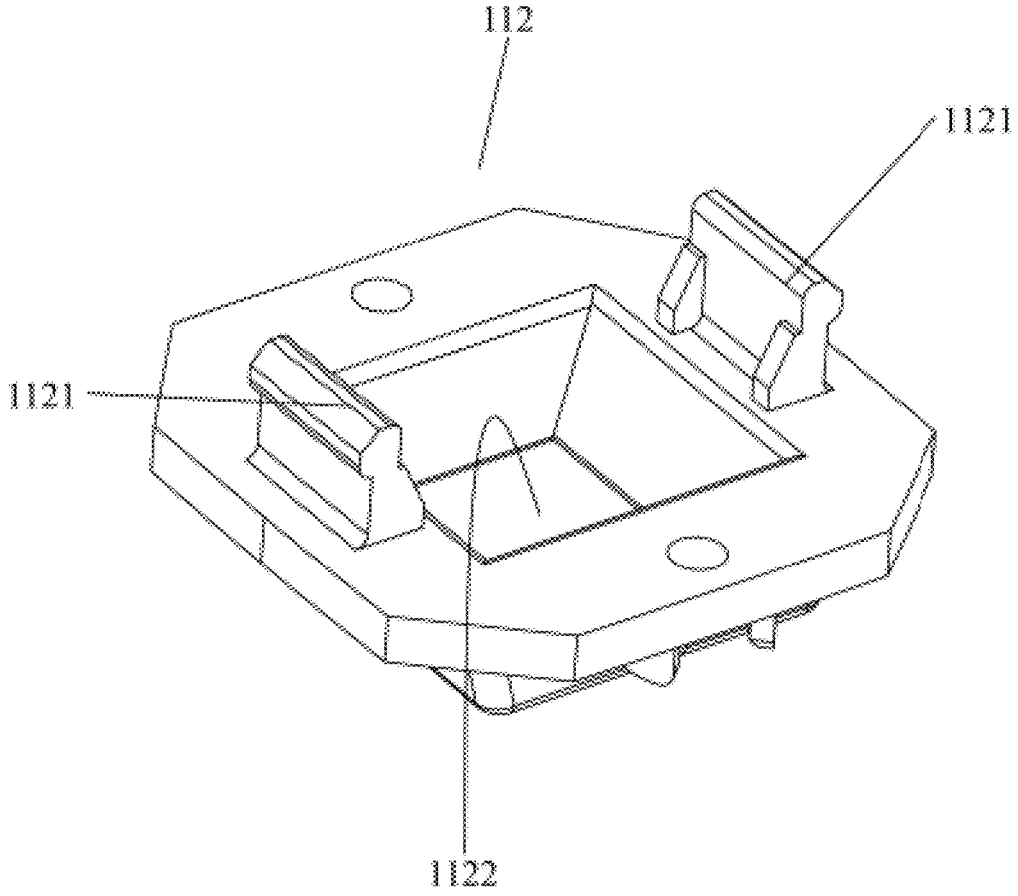
FIG. 6 is a schematic three-dimensional diagram of a connecting seat according to the present invention.
Figure 7:
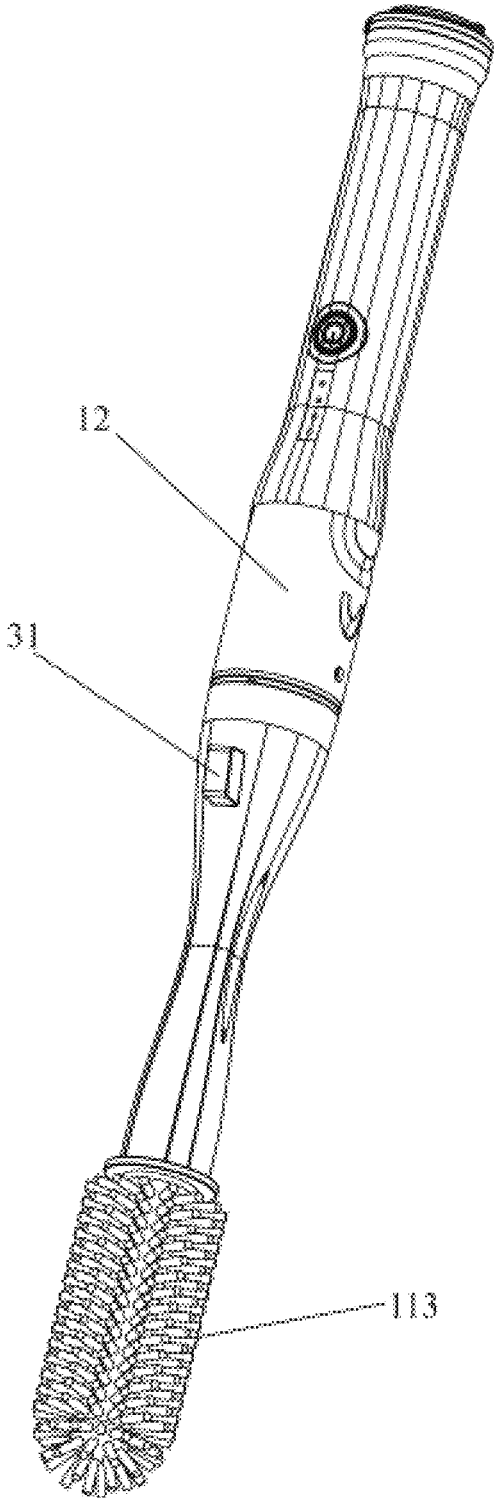
FIG. 7 is a schematic three-dimensional diagram of a cleaning apparatus mounted with an electric brush head according to the present invention.
Figure 8:
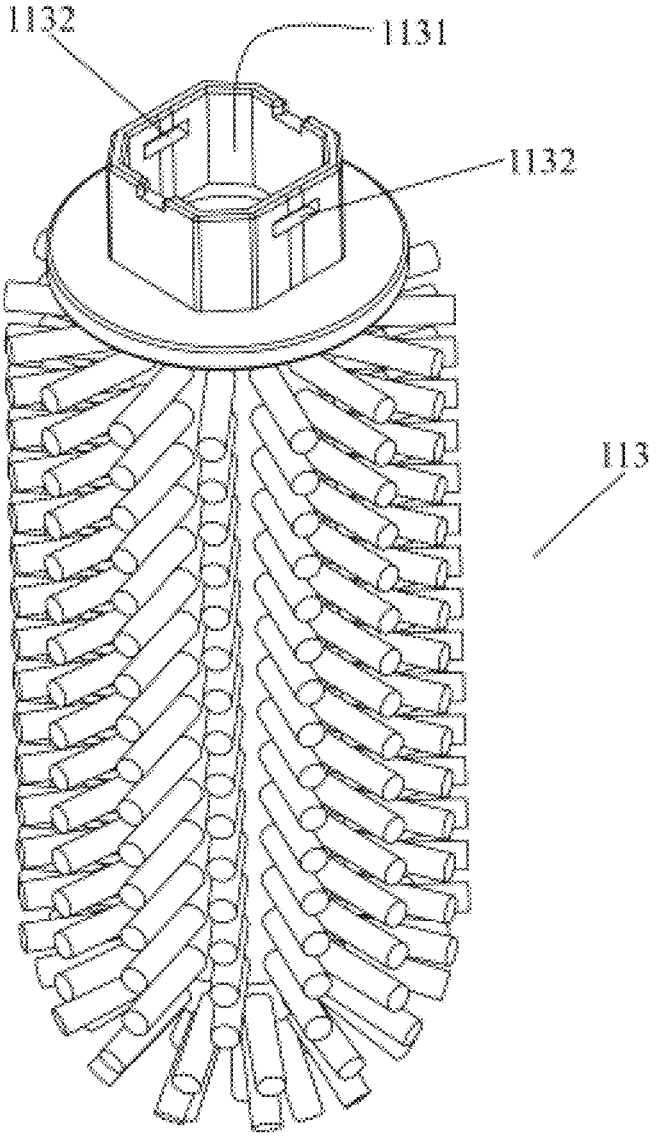
FIG. 8 is a schematic three-dimensional diagram of the electric brush head according to the present invention.
Figure 9:
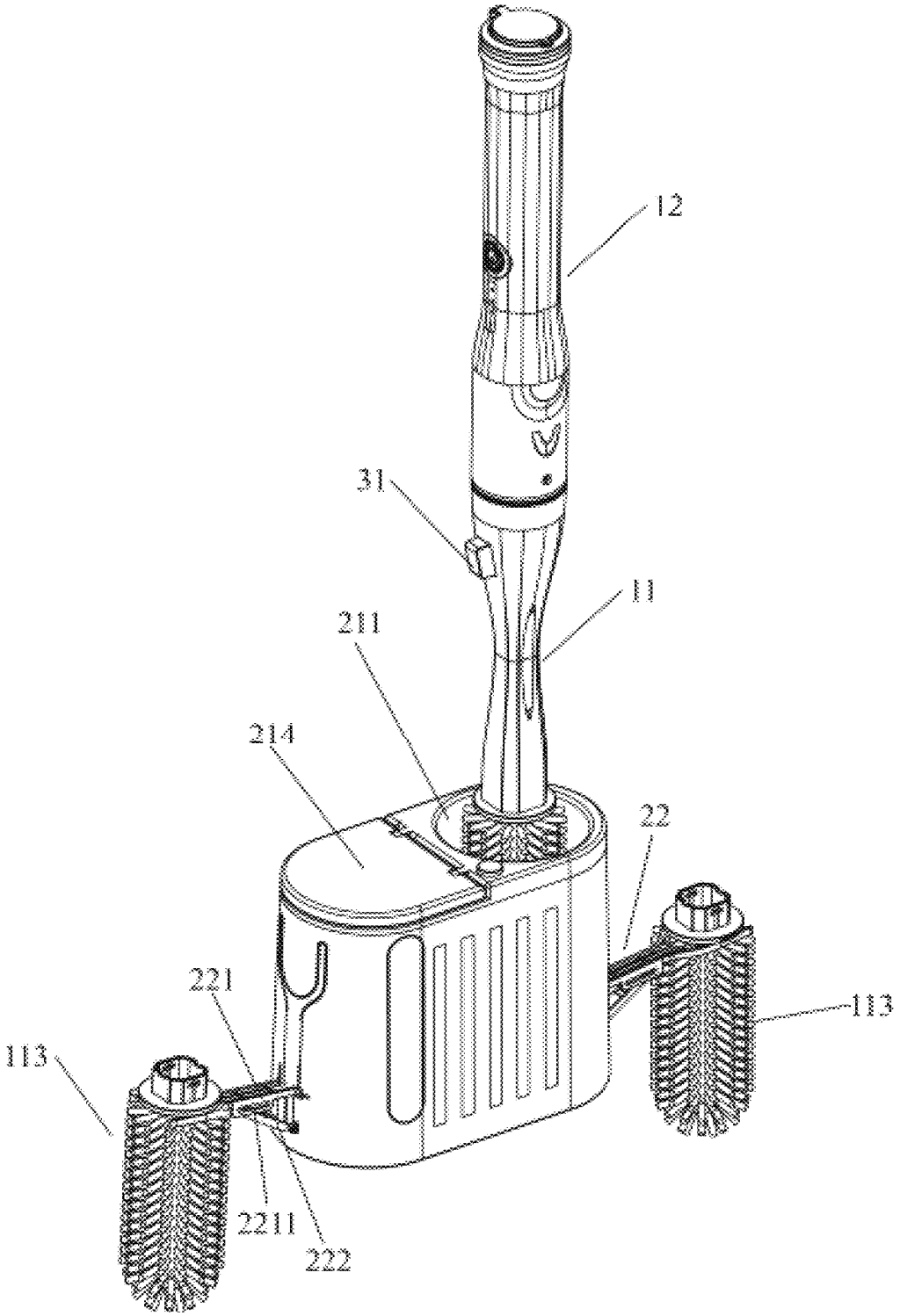
FIG. 9 is a schematic three-dimensional diagram of the cleaning apparatus and the electric brush head being placed in a storage box according to the present invention.
Figure 10:
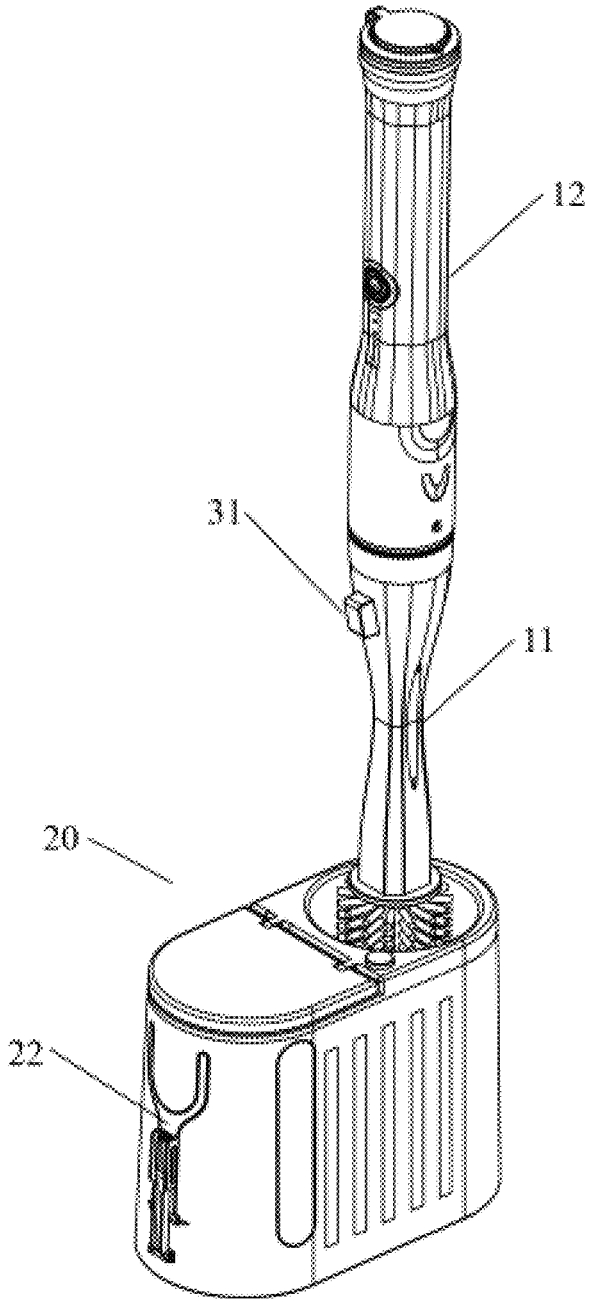
FIG. 10 is a schematic three-dimensional diagram of placement brackets of the storage box being folded according to the present invention.
Figure 11:
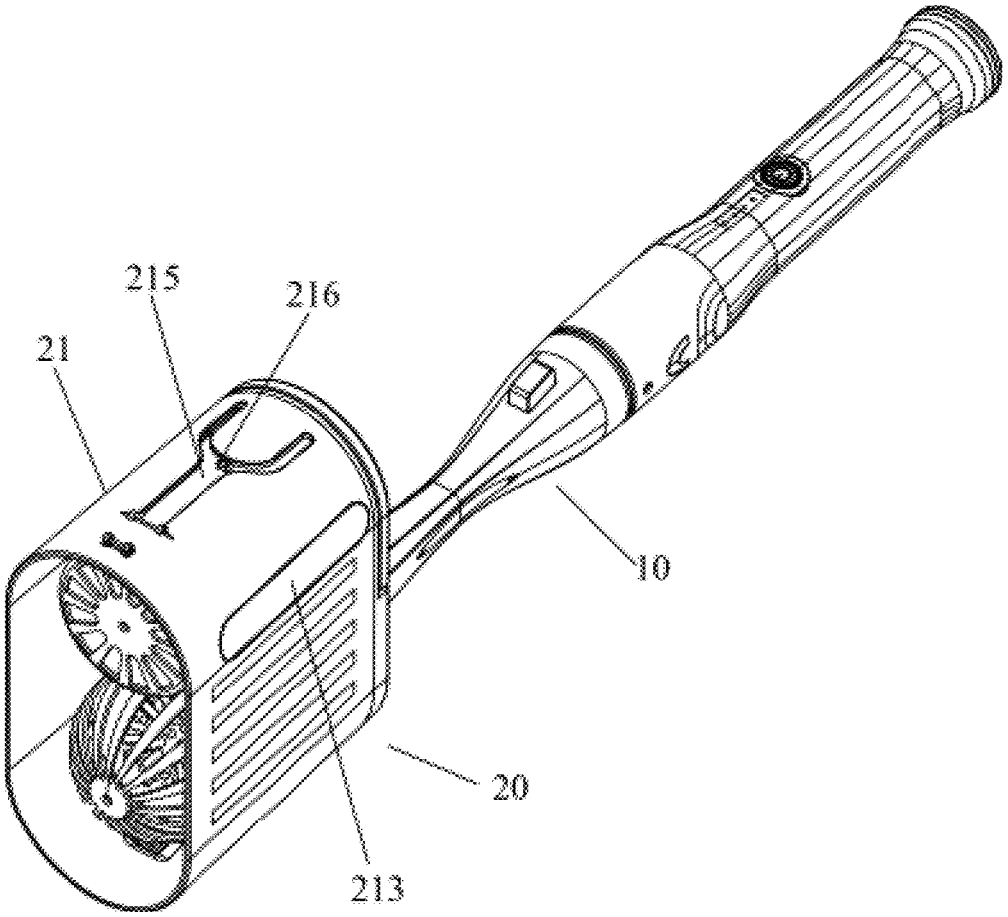
FIG. 11 is a schematic diagram of a storage slot of the storage box according to the present invention.
Figure 12:
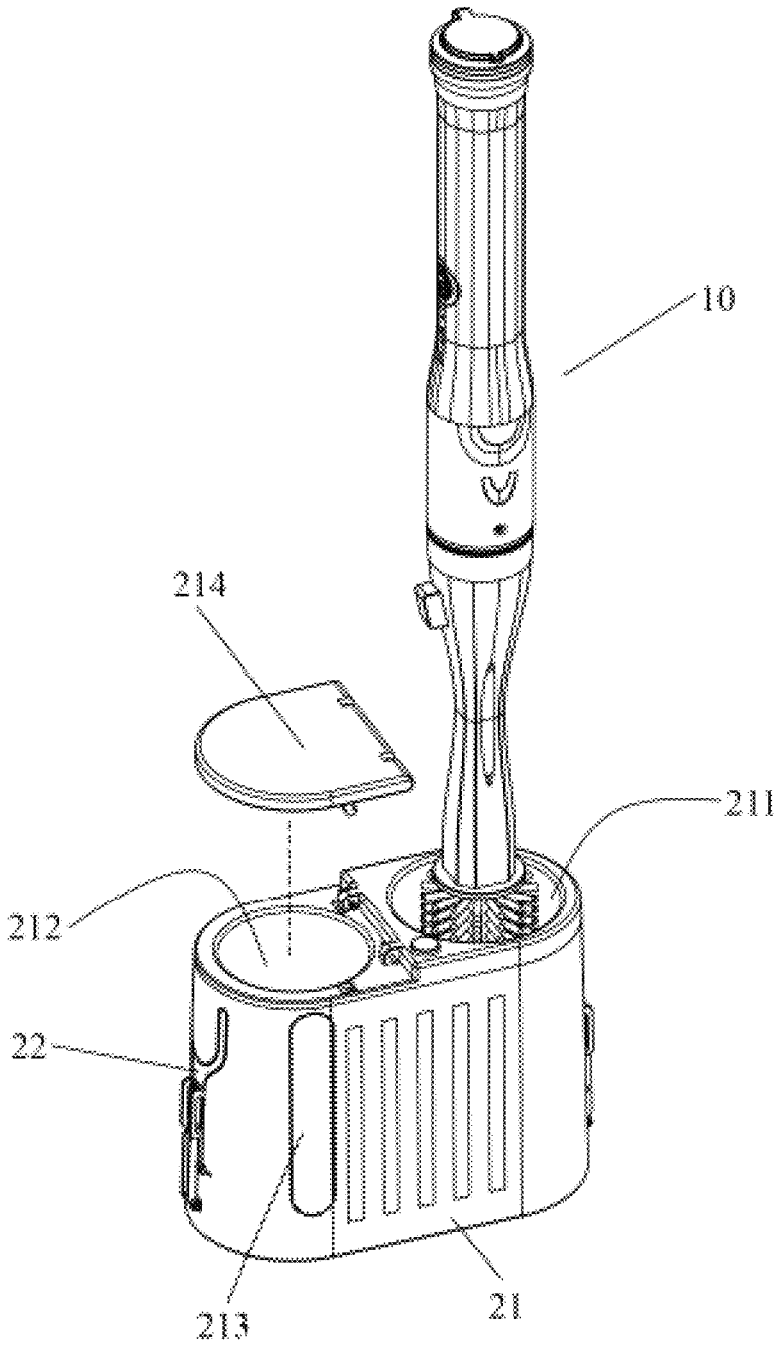
FIG. 12 is a schematic three-dimensional diagram of a cover plate of the storage box being separated from a storage body according to the present invention.

As shown in FIGS. 1 to 12, the present invention provides an integrally electric and manual cleaning apparatus 10 and a storage box 20. The cleaning apparatus 10 includes a cleaning portion 11 and a drive portion 12 configured to drive the cleaning portion 11 to rotate.

The drive portion 12 includes a handle housing 121, a battery 122 mounted in the handle housing 121, a motor 123, and a coupling 124. The battery 122 is mounted at an upper end of an inner side of the handle housing 121, the motor 123 is mounted at a lower end of the inner side of the handle housing 121 and electrically connected to the battery 122, and the coupling 124 is mounted at a shaft end of the motor 123 and connected to the cleaning portion 11. The battery 122 supplies power to the motor 123, and the motor 123 drives the coupling 124 to rotate, thereby driving the cleaning portion 11 to perform a cleaning operation.

The cleaning portion 11 is mounted on the coupling 124 and includes a sleeve tube 111, a connecting seat 112 mounted at a lower end of the sleeve tube 111, an electric brush head 113 detachably mounted on the connecting seat 112, and a clamping mechanism 30 configured to mount a disposable brush head 114. A lower surface of the connecting seat 112 is provided with a retaining block 1121, an upper end of the electric brush head 113 is provided with a fitting groove 1131, a wall surface of the fitting groove 1131 is provided with a retaining hole 1132 in correspondence with the retaining block 1121, and the retaining block 1121 is detachably mounted in the retaining hole 1132. The electric brush head 113 is mounted on the connecting seat 112 through the fitting between the retaining block 1121 and the retaining hole 1132.

The clamping mechanism 30 includes a trigger 31, a clamping assembly 32, and a linkage assembly 33. The trigger 31 serves as a component that triggers an action of the linkage assembly 33 and is mounted on the sleeve tube 111 in a pressable manner, the clamping assembly 32 extends out of the connecting seat 112, and the linkage assembly 33 is located on an inner side of the sleeve tube 111 and connected between the trigger 31 and the clamping assembly 32. The disposable brush head 114 is detachably mounted on the clamping assembly 32.

The linkage assembly 33 includes a drive rod 331, a first resetting member 332, and a second resetting member 333. The drive rod 331 is vertically slidably mounted in the sleeve tube 111. A fitting slope 3311 is disposed at an upper end of the drive rod 331, the trigger 31 serves as a button, a drive slope 311 in correspondence to the fitting slope 3311 is disposed at a lower end of the button, and the drive slope 311 is in slidable contact with the fitting slope 3311. The first resetting member 332 abuts between the button and an inner wall of the sleeve tube 111, so as to provide the button an elastic force for resetting. The second resetting member 333 abuts between a lower end of the drive rod 331 and the connecting seat 112, so as to provide the drive rod 331 an elastic force for upward resetting. The clamping assembly 32 includes two clamping blocks 321 and an elastic member 322 abutting between the two clamping blocks 321. Two upper ends of the two clamping blocks 321 are both hinged with the lower end of the drive rod 331, and the two clamping blocks 321 can be closed or separated relative to the hinge position. A middle portion of the connecting seat 112 is provided with an extension hole 1122 for the two clamping blocks 321 to extend out, so as to limit the two clamping blocks 321, thus keeping the two clamping blocks 321 in a closed state. The extension hole 1122 is square-shaped, the inner side wall of the extension hole 1122 is slope-shaped, and an inner side of the extension hole 1122 gradually widens from top to bottom. Under the downward drive of the drive rod 331, the two clamping blocks 321 gradually extend downwards out of the extension hole 1122. The elastic member 322 always provides a drive force for elastic separation between the two clamping blocks 321. As the two clamping blocks 321 extend downward, based on the inner wall structure of the extension hole 1122, which is narrow at the top and wide at the bottom, the two clamping blocks 321 gradually separate under the drive of the elastic member 322, thereby allowing the disposable brush head to be removed from the two clamping blocks 321.

Lower ends of the two clamping blocks 321 are both provided with an arc-shaped groove 323. The disposable brush head 114 includes a brush head body 1141 and a connector 1142 connected to a middle portion of the brush head body 1141. The connector 1142 is sphere-shaped and detachably retained in the arc-shaped groove 323 under the clamping of the two clamping blocks 321.

An outer wall of the sleeve tube 111 is provided with an accommodation hole 1111 for accommodating the trigger 31, a side wall of the trigger 31 is provided with a limiting step 312 for preventing the trigger 31 from detaching from the accommodation hole 1111, and the limiting step 312 blocks an edge on an inner side of the accommodation hole 1111. The fitting slope 3311 of the drive rod 331 is provided with a limit sliding groove 3312 in correspondence with the trigger 31, and the drive slope 311 of the trigger 31 is located in the limit sliding groove 3312. The fitting of the limit sliding groove 3312 and the drive slope 311 makes the linkage between the trigger 31 and the drive rod 331 more precise. When the trigger 31 is pressed, the drive rod 331 can respond quickly, and the overall structure fits more tightly, avoiding any partial shaking of the trigger 31 during pressing.

A lower end of the sleeve tube 111 is provided with an accommodation recess 1112, the accommodation recess 1112 is polygonal, and a support step 1113 is disposed in the accommodation recess 1112. The connecting seat 112 in correspondence with the accommodation recess 1112 is also polygonal and detachably mounted on the support step 1113. The polygonal connecting seat 112 is accommodated at the lower end of the sleeve tube 111 via the polygonal accommodation recess 1112. Through the combination of the support step 1113 and screws, the connecting seat 112 is tightly embedded in the sleeve tube 111, enhancing the overall structural stability and durability of the product.

A storage box 20 for storing the integrally electric and manual cleaning apparatus 10 includes a storage body 21 and placement brackets 22 that are foldable to be mounted on two sides of the storage body 21 for placement of the electric brush head 113. The storage body 21 is provided with a first storage cavity 211 for placing the cleaning apparatus 10 and a second storage cavity 212 for placing multiple such disposable brush heads 114. The placement bracket 22 includes a horizontal support member 221 and an inclined support member 222. An upper end of the horizontal support member 221 is fork-shaped, such that the electric brush head 113, when not used, can be placed on the horizontal support member for air drying. The lower ends of the horizontal support member 221 and the inclined support member 222 are both hinged to the outer wall of the storage body 21, with the hinge position between the lower end of the inclined support member 222 and the storage body 21 being located below the lower end of the horizontal support member 221. A sliding groove 2211 is transversely arranged in the middle of the horizontal support member 221, and the upper end of the inclined support member 222 slidably fits with the sliding groove 2211, allowing the horizontal support member 221 and the inclined support member 222 to be folded in conjunction. Additionally, the side wall of the storage body 21 is provided with a storage slot 215 corresponding to the horizontal support member 221 and the inclined support member 222. A retaining protrusion 216 is arranged in the storage slot 215 to limit the horizontal support member 221 when the horizontal support member 221 is flipped upward and engaged in the storage slot 215, preventing it from detaching from the storage slot 215.

The storage body 21 is provided with an observation window 213, in correspondence with the second storage cavity 212, for observing the number of the disposable brush heads 114 in the second storage cavity 212 (multiple disposable brush heads 114 are stacked in the second storage cavity 212); and a button-type cover plate 214 is mounted at an entrance of the second storage cavity 212. The cover plate 214 is driven to open using a button; once the button is pressed, the cover plate 214 opens. The linkage principle pertains to conventional technology and will not be elaborated herein. The entire storage box 20 can be hung on a wall or placed in a corner using a hook.

The working principle and usage method of this product are as follows:

When the disposable brush head 114 is used, the cover plate 214 of the storage box 20 is opened, and the trigger 31 is pressed. The drive rod 331 moves downward by the push of the trigger 31. The clamping assembly 32 extends downward from the extension hole 1122 of the connecting seat 112, and the two clamping blocks 321 separate from each other under the drive of the elastic member 322. In addition, the disposable brush head 114 in the upper layer of the second storage cavity 212 of the storage box 20 can be mounted between the two clamping blocks 321. The trigger 31 is then released, the drive rod moves upward, and the clamping assembly 32 moves upward accordingly. The two clamping blocks 321 tightly clamp the disposable brush head 114 under the restriction of the wide-top narrow-bottom structure of the extension hole 1122 of the connecting seat 112, allowing for a manual cleaning operation. When the disposable brush head 114 is removed, the trigger 31 is pressed, the two clamping blocks 321 separate from each other, and the disposable brush head 114 detaches from the clamping assembly 32. All operations requiring no contact with the disposable brush head 114, only the clamping assembly 32 needs to be aligned with the disposable brush head 114 and the trigger 31 is operated.

When the electric brush head 113 is used, the disposable brush head 114 is first removed from the clamping assembly 32, and then the electric brush head 113 is engaged with the connecting seat 112. When the electric brush head 113 is not in use, the electric brush head 113 can be removed from the connecting seat 112 and the placement bracket 22 of the storage box 20 can be opened (when the placement bracket 22 is not in use, the placement bracket 22 can be folded into the storage slot 215 of the storage box 20), and the electric brush head 113 is placed on the fork at the upper end of the placement bracket 22 for air drying. When not in use, the cleaning apparatus 10 can be placed in the first storage cavity 211 of the storage box 20.

The main design focus of the present invention is that as a clamping mechanism that can clamp a disposable brush head is disposed in the electric cleaning apparatus, the electric cleaning apparatus can also be used for a manual cleaning operation. This allows the user to freely choose between electric and manual cleaning modes based on specific cleaning needs, resulting in convenient use. The clamping mechanism does not require manual contact with the disposable brush head during the operations of clamping and releasing the disposable brush head, which avoids direct manual contact with the dirty disposable brush head when the disposable brush head is replaced, making the operation process more hygienic. Additionally, the pressable linkage clamping and releasing operations make the disassembly and assembly of the disposable brush head quicker and more convenient. Additionally, a storage box is designed for the cleaning apparatus. This storage box stores not only the cleaning apparatus but also the electric brush head and the disposable brush head, bringing numerous conveniences to the user.

The above description shows merely preferred embodiments of the present invention and is not intended to limit the technical scope of the present invention. Any minor modifications, equivalent changes, and adjustments made based on the technical essence of the present invention still fall within the scope of the technical solution of the present invention.

The invention claimed is:

1. An integrally electric and manual cleaning apparatus, comprising a cleaning portion and a drive portion configured to drive the cleaning portion to rotate, wherein the cleaning portion is mounted at an output end of the drive portion, and the cleaning portion comprises a sleeve tube, a connecting seat mounted at a lower end of the sleeve tube, an electric brush head detachably mounted on the connecting seat, and a clamping mechanism configured to mount a disposable brush head; wherein the clamping mechanism comprises a trigger, a clamping assembly, and a linkage assembly, the trigger is mounted on the sleeve tube in a pressable manner, the clamping assembly extends out of the connecting seat, the linkage assembly is located on an inner side of the sleeve tube and connected between the trigger and the clamping assembly, and the disposable brush head is detachably mounted on the clamping assembly;

the linkage assembly comprises a drive rod, a first resetting member, and a second resetting member, and the drive rod is vertically slidably mounted in the sleeve tube; a fitting slope is disposed at an upper end of the drive rod, the trigger serves as a button, a drive slope in correspondence to the fitting slope is disposed at a lower end of the button, and the drive slope is in slidable contact with the fitting slope, the first resetting member abuts between the button and an inner wall of the sleeve tube, the second resetting member abuts between a lower end of the drive rod and the connecting seat, the clamping assembly comprises two clamping blocks and an elastic member abutting between the two clamping blocks, and two upper ends of the two clamping blocks are both hinged with the lower end of the drive rod, and a middle portion of the connecting seat is provided with an extension hole for the two clamping blocks to extend out, so as to limit the two clamping blocks, thus keeping the two clamping blocks in a closed state.

2. The integrally electric and manual cleaning apparatus according to claim 1, wherein the extension hole is square-shaped, an inner side wall of the extension hole is slope-shaped, and the overall extension hole gradually widens from top to bottom.

3. The integrally electric and manual cleaning apparatus according to claim 1, wherein a lower surface of the connecting seat is provided with a retaining block, an upper end of the electric brush head is provided with a fitting groove, a wall surface of the fitting groove is provided with a retaining hole in correspondence with the retaining block, and the retaining block is detachably mounted in the retaining hole.

4. The integrally electric and manual cleaning apparatus according to claim 1, wherein an outer wall of the sleeve tube is provided with an accommodation hole for accommodating the trigger, a side wall of the trigger is provided with a limiting step for preventing the trigger from detaching from the accommodation hole, and the limiting step blocks an edge on an inner side of the accommodation hole; and the fitting slope of the drive rod is provided with a limit sliding groove in correspondence with the trigger, and the drive slope of the trigger is located in the limit sliding groove.

5. The integrally electric and manual cleaning apparatus according to claim 1, wherein lower ends of the two clamping blocks are both provided with an arc-shaped groove, the disposable brush head comprises a brush head body and a connector connected to a middle portion of the brush head body, and the connector is sphere-shaped and detachably retained in the arc-shaped groove.

6. The integrally electric and manual cleaning apparatus according to claim 1, wherein the drive portion comprises a handle housing, a battery mounted in the handle housing, a motor, and a coupling, the battery is mounted at an upper end of an inner side of the handle housing, the motor is mounted at a lower end of the inner side of the handle housing and electrically connected to the battery, and the coupling is mounted at a shaft end of the motor and connected to the cleaning portion.

7. The integrally electric and manual cleaning apparatus according to claim 1, wherein a lower end of the sleeve tube is provided with an accommodation recess, the accommodation recess is polygonal, and a support step is disposed in the accommodation recess; and the connecting seat in correspondence with the accommodation recess is also polygonal and detachably mounted on the support step.

8. A storage box for storing the integrally electric and manual cleaning apparatus according to claim 1, comprising a storage body and placement brackets that are foldable to be mounted on two sides of the storage body for placement of the electric brush head, and the storage body is provided with a first storage cavity for placing the cleaning apparatus and a second storage cavity for placing multiple such disposable brush heads.

9. The storage box according to claim 8, wherein the storage body is provided with an observation window, in correspondence with the second storage cavity, for observing the number of the disposable brush heads in the second storage cavity; and a button-type cover plate is mounted at an entrance of the second storage cavity.

* * * * *